United States Patent [19]

Rudolph

[11] 3,951,616

[45] Apr. 20, 1976

[54] APPARATUS FOR THE CONTINUOUS GASIFICATION OF COAL

[75] Inventor: Paul Rudolph, Bad Homburg, Germany

[73] Assignee: Metallgesellschaft Aktiengesellschaft, Frankfurt am Main, Germany

[22] Filed: Sept. 24, 1974

[21] Appl. No.: 508,783

[30] Foreign Application Priority Data

Oct. 24, 1973 Germany ..... 2353241

[52] U.S. Cl. ..... 48/85.2; 48/86 R; 110/37

[51] Int. Cl.[2] ..... C10J 3/30; C10J 3/32

[58] Field of Search ..... 48/61, 62 R, 63, 76, 48/78, 85.1, 85.2, 86 R, 89, 99, 206; 202/265; 110/37

[56] References Cited

UNITED STATES PATENTS

| | | | |
|---|---|---|---|
| 1,650,187 | 11/1927 | Climie | 48/85.2 |
| 1,679,645 | 8/1928 | Bentley et al. | 48/85.2 X |
| 1,911,586 | 5/1933 | Schneider et al. | 48/85.2 |
| 2,440,940 | 5/1948 | Galusha | 48/85.2 X |
| 2,667,409 | 1/1954 | Hubmann | 48/85.2 X |

FOREIGN PATENTS OR APPLICATIONS

| | | | |
|---|---|---|---|
| 403,824 | 1/1934 | United Kingdom | 48/86 |

*Primary Examiner*—Joseph Scovronek
*Attorney, Agent, or Firm*—Burgess, Dinklage & Sprung

[57] ABSTRACT

Coal such as caking coal is continuously gasified, with lump formation inhibited, under superatmospheric pressures and elevated temperatures by treatment with oxygen and water vapor and, if desired, additional gasifying agents in a reactor having a rotatable feeder which continuously feeds coal to be gasified and one or more stirrer arms which rotate in the upper portion of the coal bed. Each stirring arm is rotated at a peripheral velocity which is at least about 1 meter per minute at its end approximate the axis of rotation and at least 1.5 meters per minute at its end remote from the axis of rotation.

The reactor for carrying out this process includes a rotatable feeder and one or more stirrer arms which rotate in the upper portion of the coal bed. Each stirrer arm extends from an axially extending body which has a diameter of from 0.3 to 0.7 times the inside diameter of the upper region of the reactor. The cross-sectional profile of each stirrer arm is preferably approximately an obtuse-angled triangle with the upper side of the triangle rising at an angle of 17°–25°, the under side at an angle of 2°–7° and the trailing side at an angle of 60°–80° from the horizontal direction which is opposite to the direction of movement of the stirrer arm.

3 Claims, 2 Drawing Figures

APPARATUS FOR THE CONTINUOUS GASIFICATION OF COAL

BACKGROUND

This invention relates to a process for continuously gasifying coal under superatmospheric pressure and at elevated temperatures by a treatment with oxygen and water vapor and, if desired, additional gasifying agents in a reactor which comprises a rotatable feeder for continuously feeding coal and at least one stirrer arm which revolves in the upper portion of the coal bed, and to a reactor for carrying out the process. Oxygen is often fed as an oxidizing gasifying agent into the gasification process in the form of air and sometimes in the form of pure oxygen or oxygen-enriched air. Water vapor is the most usual form of the reducing gasifying agent which is also required.

Gas-producing reactors are known which comprise a water-cooled pressure housing. A feed lock and means for distributing the coal to be gasified are provided in the upper portion of the reactor. The gas producer is provided at its lower end with a rotatable grate for feeding and distributing the gasifying agents and for discharging the ash which has been formed. The ash is withdrawn below the rotary grate through an ash lock. In such reactor, gasification is effected at temperatures up to and above 800°C. and under a pressure up to about 50 kilograms above atmospheric pressure. A known gas producer is shown, e.g., in the U.S. Pat. No. 2,667,409.

The German Pat. No. 1,021,116 describes a gas producer which comprises stirrer arms revolving in the coal bed. These means disintegrate coal which has caked and are assisted by additional scraping fingers. Particularly with coal having a high caking capacity, these measures cannot always avoid a formation of large lumps of coal. If in such cases the gas producer is required to operate at a high throughput rate, a non-uniform gasification of the feedstock may give rise to disturbances which adversely affect the productivity of the process.

SUMMARY

This invention enables an economic gasification of even highly caking and swelling coal in a trouble-free operation. In the process defined first hereinbefore, this is accomplished in that each stirring arm revolves at a peripheral velocity which is at least about 1 meter per minute at its end near its axis of rotation and at least about 1.5 meters per minute at its end remote from its axis of rotation. It was believed that this relatively high peripheral velocity is not required in known gasifying processes and it has not been used also because it would involve a high consumption of energy. On the other hand, it has been found that the stirrer arms rotating at high speed not only disintegrate agglomerations of coal but also inhibit any formation of lumps of coal because the upper portion of the coal bed is maintained in a state of intense agitation.

DESCRIPTION OF THE DRAWING

The invention will be explained more fully hereinafter in conjunction with the drawing wherein.

DESCRIPTION

The ratio of the peripheral velocities of the stirrer arm at its ends close to and remote from its axis of rotation, respectively, is desirable between 1:1.5 and 1:3 and preferably less than 1:2.5. As a result, all parts of the upper portion of the coal bed where the coal has been fed is plastic because it is at a relatively low temperature of about 350°–550°C. are stirred with sufficient uniformity. Because there are only slight differences in velocity, a disturbing shifting of the coal toward the reactor wall will be avoided. Whereas the stirrer arms must not be too long, they should extend close to the inside surface of the reactor. For this reason they are attached to a thick displacement body.

In a reactor for carrying out the process, a further feature of the invention resides in that each stirrer arm extends from an axially extending displacement body, which has a diameter which is 0.3 to 0.7 times and preferably 0.4 to 0.6 times the inside diameter of the reactor in this region. As a result, there is a relatively small difference between the peripheral velocities of the stirrer arms at their ends which are close to and remote from their axis of rotation, respectively. On the other hand, there is a sufficiently large annular area between the displacement body and the inside surface of the reactor to permit of a sprinkling of new coal onto the coal bed and of a withdrawal of the gases and vapors which have been evolved.

Two stirrer arms are preferably mounted on the displacement body at mutually offset locations which are selected so that in the operation of the reactor one arm is 25–35 centimeters and the other 40–70 centimeters below the surface of the coal bed. As a result, a good stirring of the coal is achieved in that layer of the coal bed in which the coal is plastic owing to the temperatures prevailing there.

Figure 1:
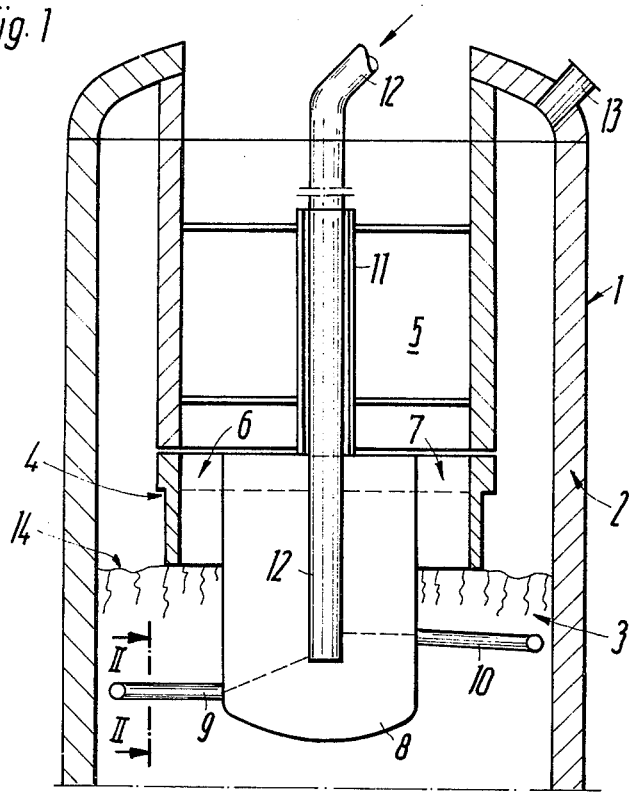
FIG. 1 is a vertical sectional view showing the upper portion of a gasification reactor.

The reactor of FIG. 1 has a double-walled housing 1, which is provided with a cooling water jacket 2. Rotatable means 4 for feeding and stirring the coal to be gasified are disposed in and over the coal bed 3. The coal held ready in a supply bin 5 is continuously distributed by the means 4 onto the bed of coal through feed chutes 6 and 7. The gaseous reaction products are withdrawn through passage 13.

The feeding and stirring means comprise also a central displacement body 8, from which two stirrer arms 9 and 10 extend. The feeding and stirring means are driven via hollow shaft 11 by means (not shown). One or more cooling water conduit 12 extend through the hollow shaft into the displacement body and is branched therein to extend into the stirrer arms as shown by the dotted lines.

The pressures prevailing in the reactor during the gasification amount to about 20–50 ata (absolute pressure in kilograms per square centimeter) although higher or lower pressures may be employed. The temperature in the coal bed varies from 300°C. close to the surface 14 to above 800°C. in the interior of the bed. During a gasification of highly caking and swelling coal, the temperature range from 350°–600°C., in which the coal becomes plastic, is most critical. These temperatures are obtained in the upper portion of the coal bed to a depth of approximately 80–100 centimeters. The displacement body 8 has such a length that it extends through said layer of plastic coal. The two stirrer arms are disposed in the plastic layer at mutually staggered locations, one of which is spaced 25–35 centimeters and the other 40–70 centimeters from the surface 14 of the coal bed.

The stirrer arms are designed to optimally loosen the coal bed as they revolve so that an agglomeration of the coal is avoided and a continual mixing of the coal being plasticized with fresh coal coming from the feed chutes is enabled. The length of the stirrer arms 9 and 10 is decreased because they extend from a thick displacement body which has a diameter that is at least 0.3 times the inside diameter of the reactor on that level. As a result, the coal is displaced from the region near the axis of rotation. Where known stirrers are used, the stirrer arms are necessarily moved only slowly so that the material to be gasified is poorly stirred in that region. A poor stirring and agitation of the coal involves also a poor flow of the oxygen-containing gasifying agents. For this reason, in known gas producers the temperature on a given level of the coal bed is much lower adjacent to the longitudinal axis than at the outside boundary, where the bed is more highly loosened and passed through by gas.

In the reactor according to the invention, the stirrer arms extending from the displacement body 8 are relatively short so that during a rotation of said arms their peripheral velocity at the outer end is not more than three times the peripheral velocity at the inner end of each stirrer arm. The diameter of the displacement body and the length of the stirrer arms are usually selected so that the peripheral velocity at the outer end of the stirrer arm is 1.5 to 2.5 times the velocity at the inner end of the stirrer arm. The feeding and stirring means are rotated at such a speed that the corotating stirrer arms have at their inner end a peripheral velocity of about 1 meter per minute. It has been found that this velocity is necessary to avoid any agglomeration of the coal.

Figure 2:
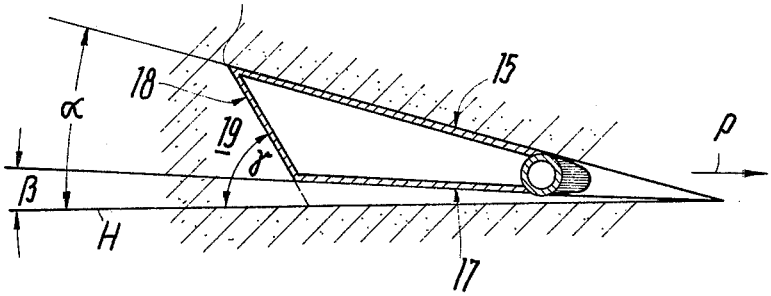
FIG. 2 is an enlarged transverse sectional view taken on line II—II in FIG. 1 and showing a stirrer arm.

A certain cross-sectional shape for the stirrer arms is required for maintaining in the upper portion of the coal bed a coal layer loose and highly permeable to the gasifying agents. This shape is shown in FIG. 2. The upper side 15 of each stirrer arm rises at an angle $\alpha$ of 17°–25° from the horizontal H. Because the stirrer arm moves in operation in the direction of the arrow P (FIG. 2), coal particles rise along the upper side 15 and fall down over the upper rear edge 16. This provides for a large free surface area in the coal bed so that the access of the gaseous gasifying agents is highly promoted. This result is further improved in that the underside 17 of the stirrer arm also rises somewhat opposite to the direction of movement, preferably by an angle $\beta$ of 2°–7°. For a further optimization, the rear side 18 is inclined from the horizontal by an angle $\gamma$ of 60°–80°. As a result, the top edge 16 protrudes slightly so that the coal falling over said edge is further disintergrated and a large-volume cavity 19 is formed in the coal bed. The cavity 19 extends below the underside 17 and provides for a preferred flow path for the gasifying agents.

The stirrer arms 9 and 10 of that design produce a high agitation in the coal bed and highly loosen the same. They impart to the coal bed a state in which it is similar to a fluidized bed so that the mixing of freshly fed coal and coal which is already being softened and degasified is intensified. This mixing also opposes agglomeration.

Owing to the measures taught by the invention, the gas flows more uniformly through the bed of coal formed in the annular space between the displacement body 8 and the reactor housing 1. As a result, the radial temperature gradient is negligibly small. The advantages afforded by the process enable also the use of coal having a relatively large particle size range. The ratio of the smallest to the largest particle size of the coal may be as small as 1:10 and the largest particle sizes may be approximately between 50 and 100 millimeters.

What is claimed is:

1. Reactor for continuously gasifying coal under superatmospheric pressures and elevated temperatures by a treatment with oxygen and water vapor comprising rotatable feeder means for continuously feeding coal and at least one stirrer arm means extending close to the inside surface of the reactor which revolves in the upper portion of the coal bed, each stirrer arm means extending from an axially extending displacement body having a diameter which is 0.3 to 0.7 times the inside diameter of the upper region of the reactor, the cross-sectional profile of each stirrer arm being approximately an obtuse angled triangle and the upper side of the triangle rising at an angle $\alpha$ of 17°–25° and its trailing side at an angle $\gamma$ of 60°–80° from the horizontal direction in opposite direction to movement of the stirrer arm.

2. Reactor of claim 1 having two stirrer arm means, one of which is 25–35 centimeters and the other 50–70 centimeters below the surface of the coal bed.

3. Reactor of claim 1 wherein the underside of said triangle rises at an angle $\beta$ of 2°–7°.

* * * * *